US011361716B2

(12) United States Patent
Kim et al.

(10) Patent No.: US 11,361,716 B2
(45) Date of Patent: Jun. 14, 2022

(54) PIXEL SENSING CIRCUIT AND PANEL DRIVING DEVICE

(71) Applicant: SILICON WORKS CO., LTD., Daejeon (KR)

(72) Inventors: Won Kim, Daejeon (KR); Young Bok Kim, Daejeon (KR); Young Ho Shin, Daejeon (KR)

(73) Assignee: SILICON WORKS CO., LTD., Daejeon (KR)

( * ) Notice: Subject to any disclaimer, the term of this patent is extended or adjusted under 35 U.S.C. 154(b) by 0 days.

(21) Appl. No.: 17/176,828

(22) Filed: Feb. 16, 2021

(65) Prior Publication Data

US 2021/0272524 A1 Sep. 2, 2021

(30) Foreign Application Priority Data

Feb. 28, 2020 (KR) ..... 10-2020-0024704

(51) Int. Cl.
*G09G 3/3275* (2016.01)
*G09G 3/3233* (2016.01)

(52) U.S. Cl.
CPC ..... *G09G 3/3275* (2013.01); *G09G 3/3233* (2013.01); *G09G 2310/0297* (2013.01); *G09G 2320/0233* (2013.01); *G09G 2320/045* (2013.01)

(58) Field of Classification Search
CPC ..... G09G 3/3275; G09G 3/3233; G09G 2310/0297; G09G 2320/0233; G09G 2320/045; G09G 2300/0819; G09G 2300/0842; G09G 2320/0295; G09G 2320/043; G09G 3/3208; G09G 3/006; G09G 3/3291; G09G 3/3225; G09G 2300/0828; G09G 2310/0264; G09G 2320/029
See application file for complete search history.

(56) References Cited

U.S. PATENT DOCUMENTS

| | | | | |
|---|---|---|---|---|
| 10,665,156 | B2 | 5/2020 | Huang et al. | |
| 2013/0162617 | A1* | 6/2013 | Yoon | G09G 3/3291 345/76 |
| 2016/0078805 | A1* | 3/2016 | Woo | G09G 3/3225 345/78 |
| 2017/0004764 | A1* | 1/2017 | Kim | G09G 3/3225 |
| 2017/0004776 | A1* | 1/2017 | Park | G09G 3/3233 |
| 2018/0075798 | A1* | 3/2018 | Nho | G09G 3/32 |
| 2018/0190203 | A1* | 7/2018 | Hwang | G09G 3/3291 |
| 2019/0079606 | A1* | 3/2019 | Kim | G09G 3/3233 |
| 2020/0193918 | A1* | 6/2020 | Hwang | G09G 3/3233 |
| 2020/0202777 | A1* | 6/2020 | Lee | G09G 3/3233 |
| 2020/0357338 | A1* | 11/2020 | Lee | G09G 3/325 |

FOREIGN PATENT DOCUMENTS

| | | | |
|---|---|---|---|
| KR | 10-0915610 | B1 | 9/2009 |
| KR | 10-2018-0013294 | A | 2/2018 |

* cited by examiner

*Primary Examiner* — Ibrahim A Khan
(74) *Attorney, Agent, or Firm* — Fenwick & West LLP

(57) ABSTRACT

The present disclosure relates to a pixel sensing circuit and a panel driving device, and more particularly, to a pixel sensing circuit and a panel driving device for effectively compensating for differences of characteristics of sensing channel circuits depending on locations where the sensing channel circuits are disposed in an integrated circuit.

10 Claims, 9 Drawing Sheets

PIXEL SENSING CIRCUIT AND PANEL DRIVING DEVICE

CROSS-REFERENCE TO RELATED APPLICATION

This application claims priority from Republic of Korea Patent Application No. 10-2020-0024704, filed on Feb. 28, 2020, which is hereby incorporated by reference in its entirety.

BACKGROUND

1. Technical Field

The present disclosure relates to a pixel sensing circuit and a panel driving device.

2. Related Art

A display device comprises a source driver for driving pixels disposed in a panel.

The source driver determines a data voltage based on image data, and controls brightness of each pixel by supplying such a data voltage to the pixels.

Although the same data voltage is supplied, brightness of each pixel may be different depending on characteristic differences among the pixels. For example, the pixel includes a driving transistor. If a threshold voltage of the driving transistor is changed, brightness of the pixel is changed although the same data voltage is supplied. If the source driver does not consider such characteristic differences among the pixels, there may be problems in that the pixels are driven with undesirable brightness and picture quality is degraded.

Specifically, characteristics of the pixels may be changed over time or depending on a surrounding environment. In this case, if the source driver supplies a data voltage without considering the changed characteristics of the pixels, there is a problem in that picture quality is degraded (e.g., a problem, such as a screen spot, occurs).

In order to solve a problem, such as the degradation of picture quality, the display device may include a pixel sensing circuit for sensing characteristics of the pixels. In this case, the pixel sensing circuit and the source driver may be mounted on one integrated circuit (IC).

The pixel sensing circuit may receive an analog signal for each pixel through a sensing line coupled to each pixel. Furthermore, the pixel sensing circuit may convert the analog signal into pixel sensing data, that is, digital data, and may transmit the pixel sensing data to a timing controller.

The timing controller checks a characteristic of each pixel based on the pixel sensing data received from the pixel sensing circuit. Furthermore, the timing controller can alleviate the degradation of the image quality due to the characteristic differences among the pixels by compensating for a characteristic difference of each pixel form the others through the adjustment of image data.

The pixel sensing circuit may include multiple sensing channel circuits in order to measure many pixels (e.g., thousands of pixels or more) disposed in the panel within a short time.

The pixel sensing data may include characteristics of the multiple sensing channel circuits as well as characteristics of pixels.

Accordingly, the timing controller needs to compensate for the characteristics of the multiple sensing channel circuits in the pixel sensing data before compensating for the characteristics of pixels based on the pixel sensing data.

To this end, the timing controller previously stores characteristic values (or offsets) of the multiple sensing channel circuits through a process of compensating for the pixel sensing circuit, and compensates for the characteristics of the multiple sensing channel circuits in the pixel sensing data using the characteristic values.

In this case, a characteristic of each of the multiple sensing channel circuits may be different depending on a temperature variation of the circuit occurring when the pixel sensing circuit operates. Accordingly, a difference may occur between the characteristic value previously stored in the timing controller and the characteristic of the sensing channel circuit occurring when the pixel sensing circuit operates.

As described above, in order to properly compensate for the characteristic of the sensing channel circuit varying in response to a temperature variation of the pixel sensing circuit, as in FIG. 9, a reference sensing channel circuit 920 is added to one side of multiple sensing channel circuits 912, 914 and 916.

The multiple sensing channel circuits 912, 914 and 916 output multiple pixel sensing values using analog signals for pixels, respectively. The reference sensing channel circuit 920 outputs a reference sensing value using a preset reference voltage. In this case, the multiple pixel sensing values and the reference sensing value may be analog signals.

A pixel sensing circuit 900 converts the multiple pixel sensing values and the reference sensing value, that is, analog signals, into multiple pixel sensing data and reference sensing data, that is, digital signals, respectively, through a multiplexer (MUX) and an analog-to-digital converter (ADC), and transmits the multiple pixel sensing data and the reference sensing data to the timing controller.

The timing controller may properly compensate for a change in the characteristic of the sensing channel circuit according to a temperature variation of the pixel sensing circuit 900 by comparing a previously stored characteristic value of the sensing channel circuit with a characteristic value of the reference sensing channel circuit included in the reference sensing data.

In this case, in the known pixel sensing circuit 900, the reference sensing channel circuit 920 is disposed on only one side of the multiple sensing channel circuits 912, 914 and 916, as illustrated in FIG. 9.

However, locations where the multiple sensing channel circuits 912, 914 and 916 are disposed in an IC may become different during the fabrication of the IC. Furthermore, a temperature variation occurring when the pixel sensing circuit 900 operates may also be different depending on the locations where the multiple sensing channel circuits 912, 914 and 916 are disposed. Therefore, there exist limitations in improving the sensing accuracies of all the multiple sensing channel circuits 912, 914 and 916 through the one reference sensing channel circuit 920 disposed on only one side of the multiple sensing channel circuits 912, 914 and 916.

SUMMARY

In an aspect, an object of the present disclosure is to provide a technology for effectively compensating for differences of characteristics of sensing channel circuits depending on locations where the sensing channel circuits are disposed in an IC.

To this end, in an aspect, the present disclosure provides a pixel sensing circuit configured to sense characteristics of multiple pixels disposed in a display panel comprising: a first sensing channel circuit to an N-th (N is a natural number of 2 or greater) sensing channel circuit sequentially disposed in an integrated circuit board; a first reference sensing channel circuit configured to receive a preset reference voltage and to output a first reference sensing value, the first reference sensing channel circuit being disposed adjacent to the first sensing channel circuit in the integrated circuit board; and a K-th (K is a natural number greater than 1 and smaller than N) reference sensing channel circuit configured to receive the reference voltage and to output a K-th reference sensing value, and the K-th reference sensing channel circuit being disposed adjacent to the N-th sensing channel circuit in the integrated circuit board.

The pixel sensing circuit may further comprise a second reference sensing channel circuit to receive the reference voltage and to output a second reference sensing value, the second reference sensing channel circuit being disposed adjacent to an M-th (M is a natural number greater than 2 and smaller than N) sensing channel circuit in the integrated circuit board.

The pixel sensing circuit may further include a multiplexer configured to receive a first pixel sensing value to an N-th pixel sensing value outputted from the first sensing channel circuit to the N-th sensing channel circuit, to receive the first reference sensing value and the K-th reference sensing value respectively outputted from the first reference sensing channel circuit and the K-th reference sensing channel circuit, and to sequentially output the first pixel sensing value to the N-th pixel sensing value, the first reference sensing value and the K-th reference sensing value in an order of the arrangement of the first sensing channel circuit to the N-th sensing channel circuit, the first reference sensing channel circuit and the K-th reference sensing channel circuit are disposed in the integrated circuit board; and an analog-to-digital converter configured to receive the first pixel sensing value to the N-th pixel sensing value, the first reference sensing value and the K-th reference sensing value from the multiplexer and to convert the first pixel sensing value to the N-th pixel sensing value, the first reference sensing value and the K-th reference sensing value respectively into first pixel sensing data to N-th pixel sensing data, first reference sensing data and K-th reference sensing data.

The first reference sensing channel circuit may be disposed between the first sensing channel circuit and a second sensing channel circuit, and the K-th reference sensing channel circuit may be disposed between an (N-1)-th sensing channel circuit and the N-th sensing channel circuit.

In another aspect, the present disclosure provides a panel driving device comprising: a pixel sensing circuit configured to generate a first pixel sensing value to an N-th (N is a natural number of 2 or greater) pixel sensing value for characteristics of multiple pixels disposed in a display panel, to convert the first pixel sensing value to the N-th pixel sensing value into first pixel sensing data to N-th pixel sensing data, to generate a first reference sensing value to a K-th (K is a natural number greater than 1 and smaller than N) reference sensing value for a preset reference voltage, and to convert the first reference sensing value to the K-th reference sensing value into first reference sensing data to K-th reference sensing data; and a data processing circuit configured to receive the first pixel sensing data to the N-th pixel sensing data, the first reference sensing data, and the K-th reference sensing data from the pixel sensing circuit and to compensate for the first pixel sensing data to the N-th pixel sensing data using the first reference sensing data to the K-th reference sensing data.

The data processing circuit may calculate an average value of the first reference sensing data to the K-th reference sensing data and compensate for the first pixel sensing data to the N-th pixel sensing data using the average value.

The data processing circuit may calculate an average value by multiplying the first reference sensing data to the K-th reference sensing data respectively by a preset first weight to K-th weight and averaging their multiplication results, and may compensate for the first pixel sensing data to the N-th pixel sensing data using the average value.

The pixel sensing circuit may comprise a first sensing channel circuit to an N-th sensing channel circuit sequentially disposed in an integrated circuit board and configured to respectively output the first pixel sensing value to the N-th pixel sensing value; a first reference sensing channel circuit configured to receive the reference voltage and to output the first reference sensing value, and the first reference sensing channel circuit being disposed adjacent to the first sensing channel circuit in the integrated circuit board; and a K-th reference sensing channel circuit configured to receive the reference voltage and to output the K-th (K is a natural number greater than 1 and smaller than N) reference sensing value, and the K-th reference sensing channel circuit being disposed adjacent to the N-th sensing channel circuit in the integrated circuit board.

The pixel sensing circuit may further comprise a multiplexer configured to receive the first pixel sensing value to the N-th pixel sensing value outputted from the first sensing channel circuit to the N-th sensing channel circuit, to receive the first reference sensing value and the K-th reference sensing value respectively outputted from the first reference sensing channel circuit and the K-th reference sensing channel circuit, and to sequentially output the first pixel sensing value to the N-th pixel sensing value, the first reference sensing value, and the K-th reference sensing value in an order of the arrangement of the first sensing channel circuit to the N-th sensing channel circuit, the first reference sensing channel circuit and the K-th reference sensing channel circuit in the integrated circuit board; and an analog-to-digital converter configured to convert the first pixel sensing value to the N-th pixel sensing value and the first reference sensing value to the K-th reference sensing value into digital values and to transmit the digital values to the data processing circuit.

The panel driving device may further include a data driving circuit configured to convert image data into a data voltage and to supply the data voltage to a data line, wherein the data processing circuit performs compensation processing on the image data using the first pixel sensing data to the N-th pixel sensing data.

As described above, according to the present disclosure, when the pixel sensing circuit is formed in an IC board, two reference sensing channel circuits are disposed respectively on both end sides of multiple sensing channel circuits or one or more reference sensing channel circuits are further disposed in the middle or in the intervals of multiple sensing channel circuits. Accordingly, two or more reference sensing channel circuits can output reference sensing values reflecting circuit characteristics different depending on locations where the multiple sensing channel circuits are disposed and this allows improving the sensing accuracy of the entire sensing channel circuits.

DETAILED DESCRIPTION

Figure 1:
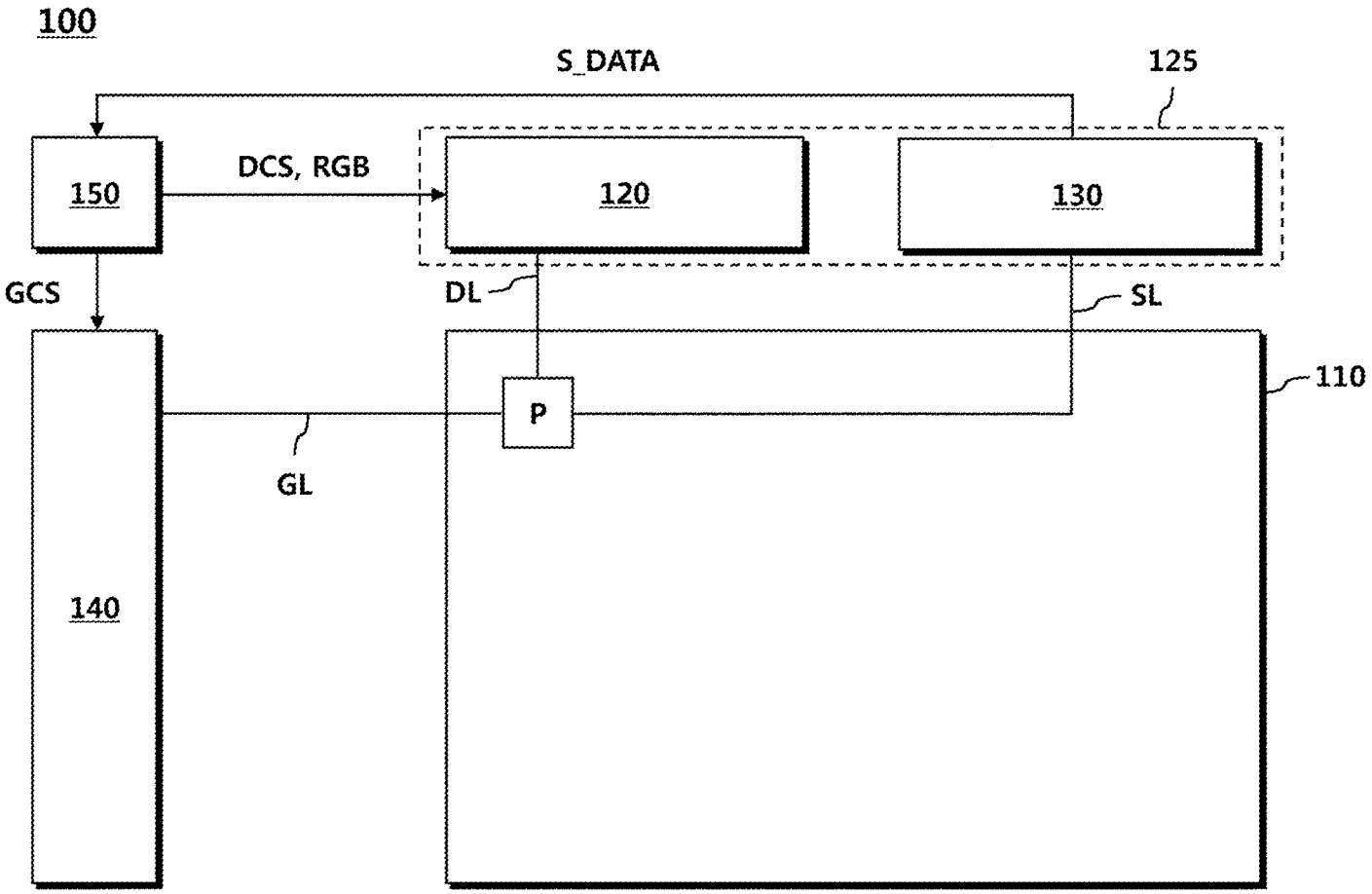
FIG. 1 illustrates a configuration of a display device according to an embodiment.

FIG. 1 illustrates a configuration of a display device according to an embodiment.

Referring to FIG. 1, the display device 100 may include a display panel 110 and panel driving circuits 120, 130, 140 and 150 for driving the display panel 110.

Multiple data lines DL, multiple gate lines GL, and multiple sensing lines SL are disposed in the display panel 110 and multiple pixels P may also be disposed in the display panel 110.

Circuits 120, 130, 140 and 150 that drive at least one element included in the display panel 110 may be referred to as panel driving circuits. For example, a data driving circuit 120, a pixel sensing circuit 130, a gate driving circuit 140, and a data processing circuit 150 may be referred to as the panel driving circuits.

In the panel driving circuit, the gate driving circuit 140 may supply the gate line GL with a scan signal such as a turn-on voltage or a turn-off voltage. When a scan signal of a turn-on voltage is supplied to a pixel P, the corresponding pixel P is connected with a data line DL, and when a scan signal of a turn-off voltage is supplied to the pixel P, the pixel P is disconnected from the data line DL.

In the panel driving circuit, the data driving circuit 120 supplies a data line DL with a data voltage. The data voltage supplied to the data line DL is transmitted to a pixel P connected with the data line DL according to a scan signal of the gate driving circuit 140.

In the panel driving circuit, the pixel sensing circuit 130 receives an analog signal (e.g., a voltage or a current) formed in each pixel P. The pixel sensing circuit 130 may be connected with each pixel P in response to a scan signal or a separate sensing signal. Here, a separate sensing signal may be generated by the gate driving circuit 140.

In the panel driving circuit, the data processing circuit 150 may supply the gate driving circuit 140 and the data driving circuit 120 with various control signals. The data processing circuit 150 may generate a gate control signal GCS that starts a scan according to a timing for each frame and transmit the gate control signal GCS to the gate driving circuit 140.

The data processing circuit 150 may convert image data inputted from an external device into image data RGB in a data format used in the data driving circuit 120 and transmit the converted image data RGB to the data driving circuit 120. In addition, the data processing circuit 150 may transmit a data control signal DCS that controls the data driving circuit 120 to supply a data voltage to each pixel P at an appropriate timing.

The data processing circuit 150 may compensate for the image data RGB based on a characteristic of each pixel P and transmit the compensated image data. At this time, the data processing circuit 150 may receive sensing data S_DATA from the pixel sensing circuit 130. Here, the sensing data S_DATA may include a measured value for the characteristic of the pixel P.

Meanwhile, a data driving circuit 120 may be referred to as a source driver, a gate driving circuit 140 may be referred to as a gate driver, and a data processing circuit 150 may be referred to as a timing controller.

A data driving circuit 120 and a pixel sensing circuit 130 may be comprised in one integrated circuit (IC) 125, and referred to as a source driver IC.

Otherwise, a data driving circuit 120, a pixel sensing circuit 130, and a data processing circuit 150 may be comprised in one IC and referred to as a unified IC. Although the present disclosure is not limited to such names, descriptions about some generally known elements of a source driver, a gate driver, a timing controller, etc. will be omitted in the descriptions of embodiments below. Accordingly, the descriptions of embodiments should be understood considering the fact that the descriptions about such some elements are omitted.

The display panel 110 may be an organic light-emitting display panel. In this case, each pixel P disposed in the display panel 110 may include an organic light-emitting diode (OLED) and one or more transistors. Characteristic of an OLED and one or more transistors included in each pixel P may vary over time or depending on surrounding environments. The pixel sensing circuit 130 according to an embodiment may sense characteristics of such elements included in each pixel P and transmit them to the data processing circuit 150.

Figure 2:
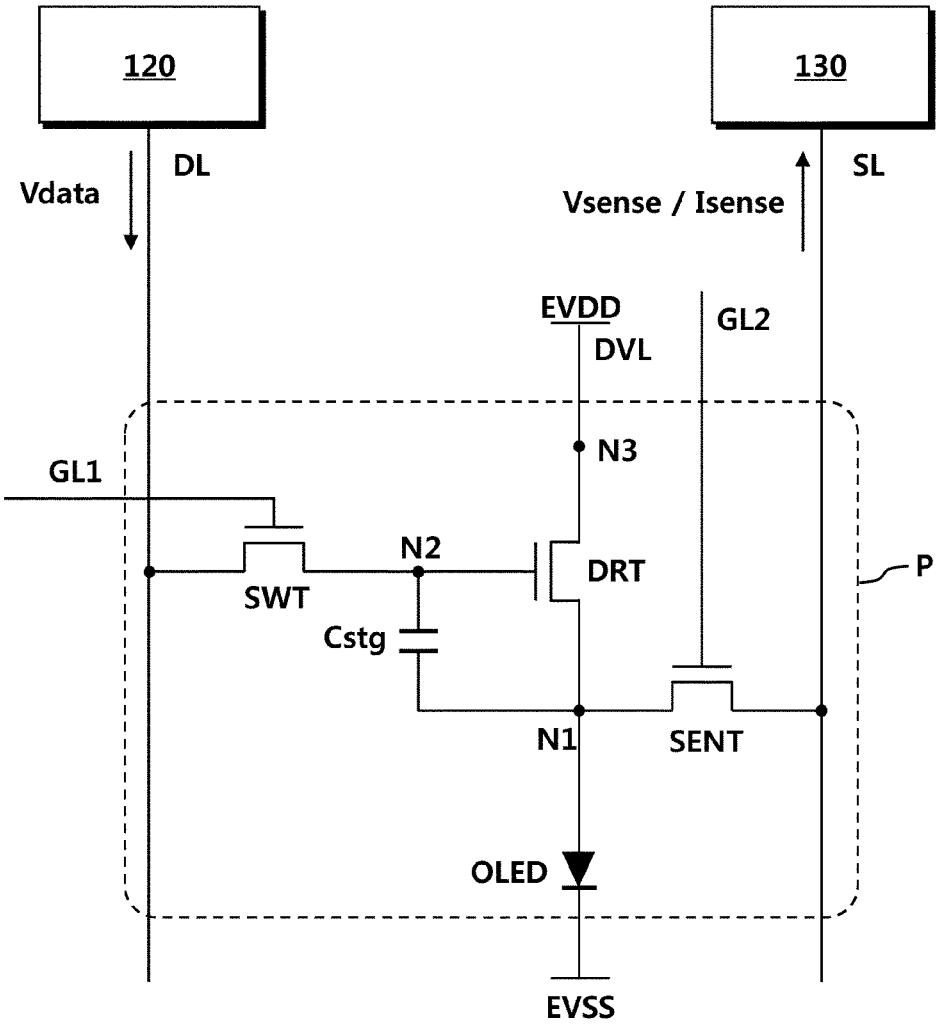
FIG. 2 is a diagram illustrating a structure of a pixel, and signals transmitted and received between the pixel and a data driving circuit and a pixel sensing circuit according to an embodiment.

FIG. 2 is a diagram illustrating a structure of a pixel, and signals transmitted and received between the pixel and the data driving circuit and the pixel sensing circuit according to an embodiment.

Referring to FIG. 2, a pixel P may include an organic light-emitting diode OLED, a driving transistor DRT, a switching transistor SWT, a sensing transistor SENT, a storage capacitor Cstg, etc.

The OLED may include an anode electrode, an organic layer, a cathode electrode, etc. According to a control of the driving transistor DRT, the anode electrode is connected with a driving voltage EVDD and the cathode electrode is connected with a base voltage EVSS so that the OLED emits light.

The driving transistor DRT may control the brightness of the OLED by controlling a driving current supplied to the OLED.

A first node N1 of the driving transistor DRT may be electrically connected with the anode electrode of the OLED. The first node N1 may be a source node or a drain node.

A second node N2 of the driving transistor DRT may be electrically connected with a source node or a drain node of the switching transistor SWT. The second node N2 may be a gate node.

A third node N3 of the driving transistor DRT may be electrically connected with a driving voltage line DVL through which the driving voltage EVDD is supplied. The third node N3 may be a drain node or a source node.

The switching transistor SWT may be electrically connected between a data line DL and the second node N2 of the driving transistor DRT and turned on by a scan signal supplied through gate lines GL1 and GL2.

When the switching transistor SWT is turned on, a data voltage Vdata, supplied from the data driving circuit 120 through the data line DL, is transmitted to the second node N2 of the driving transistor DRT.

The storage capacitor Cstg may be electrically connected between the first node N1 and second node N2 of the driving transistor DRT.

The storage capacitor Cstg may be a parasitic capacitor present between the first node N1 and second node N2 of the driving transistor DRT or an external capacitor intentionally disposed outside the driving transistor DRT.

The sensing transistor SENT may connect the first node N1 of the driving transistor DRT and a sensing line SL.

The sensing line SL may transmit a reference voltage Vref to the first node N1 and transmit, to the pixel sensing circuit 130, an analog signal (e.g., a voltage or a current) formed in the first node N1.

The pixel sensing circuit 130 measures characteristics of a pixel P using an analog signal Vsense or Isense transmitted through the sensing line SL.

When a voltage of the first node N1 is measured, a threshold voltage, mobility, a current characteristic, etc. of the driving transistor DRT may be checked. Furthermore, when a voltage of the first node N1 is measured, a degree of deterioration of the OLED, such as a parasitic capacitance, a current characteristic, etc. of the OLED, may be checked.

In addition, when a current transmitted to the first node N1 via the driving transistor DRT is measured, the current ability of the driving transistor DRT may be measured. When a current flowing into the OLED via the first node N1 is measured, a current characteristic of the OLED may be measured.

The pixel sensing circuit 130 may measure a current transmitted from or to the first node N1 and transmit pixel sensing data, which is a digital signal for a measured value, to the data processing circuit (refer to 150 of FIG. 1). The data processing circuit (refer to 150 of FIG. 1) may identify a characteristic of each pixel P by analyzing the pixel sensing data.

Figure 3:
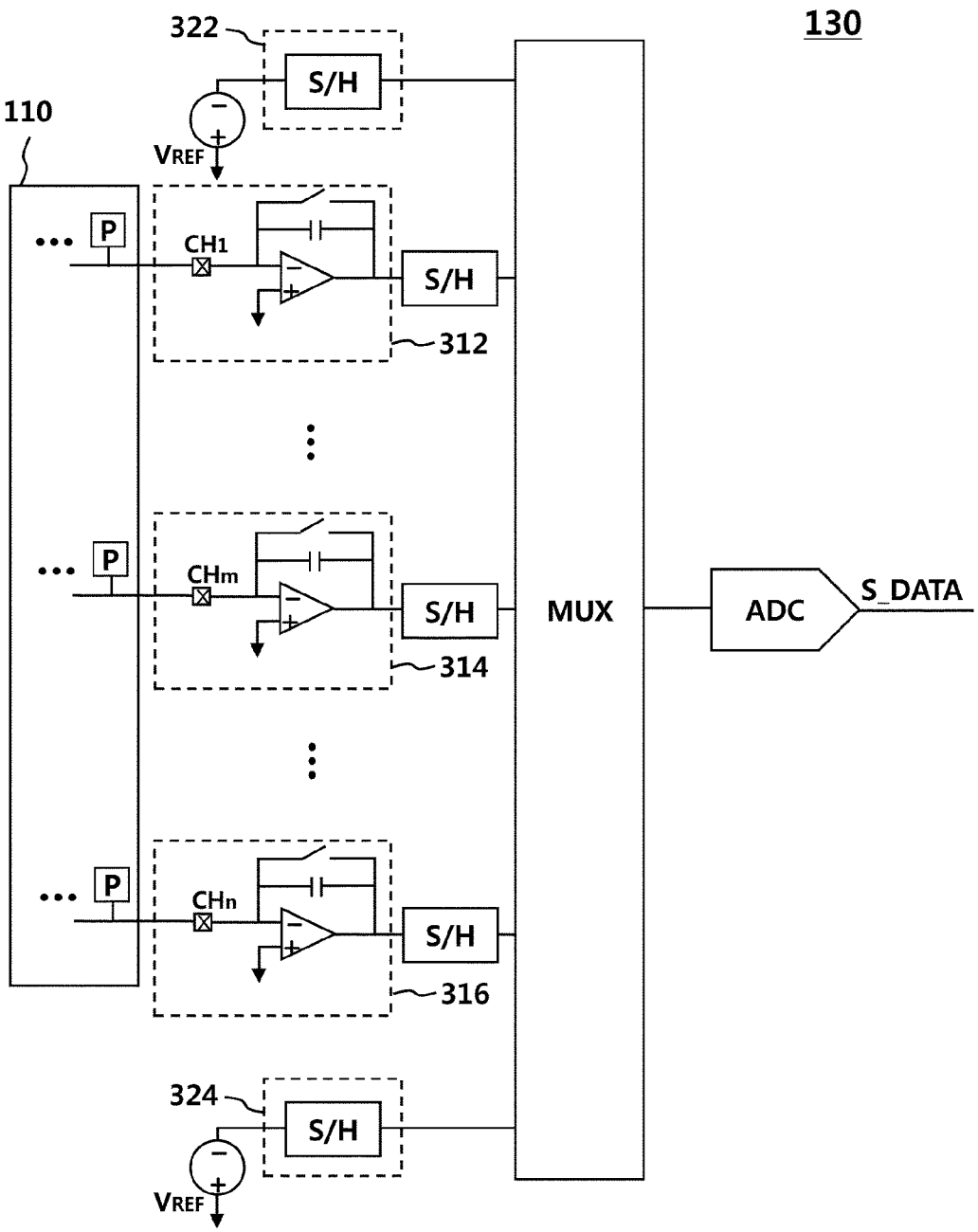
FIGS. 3 and 4 illustrate configurations of a pixel sensing circuit according to an embodiment.

The pixel sensing circuit 130 having the above-described structure may comprise multiple sensing channel circuits, that is, a first sensing channel circuit 312 to an N-th (N is a natural number of 2 or greater) sensing channel circuit 316 as illustrated in FIG. 3 in order to measure characteristics of multiple pixels P.

The first sensing channel circuit 312 to the N-th sensing channel circuit 316 may be sequentially disposed in an IC board to form an IC.

Here, the first sensing channel circuit 312 to the N-th sensing channel circuit 316 may have different circuit characteristics, due to differences obtained during fabrication, a surrounding environment, etc., depending on locations where the first sensing channel circuit 312 to the N-th sensing channel circuit 316 are disposed and this may cause differences in measurement.

In an embodiment, in order to effectively compensate for differences in measurement depending on locations where the first sensing channel circuit 312 to the N-th sensing channel circuit 316 are disposed, one reference sensing channel circuit may be disposed adjacent to the first sensing channel circuit 312 and another reference sensing channel circuit may be disposed adjacent to the N-th sensing channel circuit 316.

In other words, in an embodiment, the pixel sensing circuit 130 may comprise the first sensing channel circuit 312 to the N-th sensing channel circuit 316 sequentially disposed in the IC board and may further comprise a first reference sensing channel circuit 322 disposed adjacent to the first sensing channel circuit 312 and a K-th (K is a natural number greater than 1 and smaller than N) reference sensing channel circuit 324 disposed adjacent to the N-th sensing channel circuit 316 as illustrated in FIG. 3. Here, the first reference sensing channel circuit 322 may be a circuit configured to receive a preset reference voltage and to output a first reference sensing value and the K-th reference sensing channel circuit 324 may be a circuit configured to receive the preset reference voltage and to output a K-th reference sensing value.

The first reference sensing channel circuit 322 and the K-th reference sensing channel circuit 324 may be formed simultaneously when the first sensing channel circuit 312 to the N-th sensing channel circuit 316 are formed in the IC board during an IC fabrication process.

Figure 4:
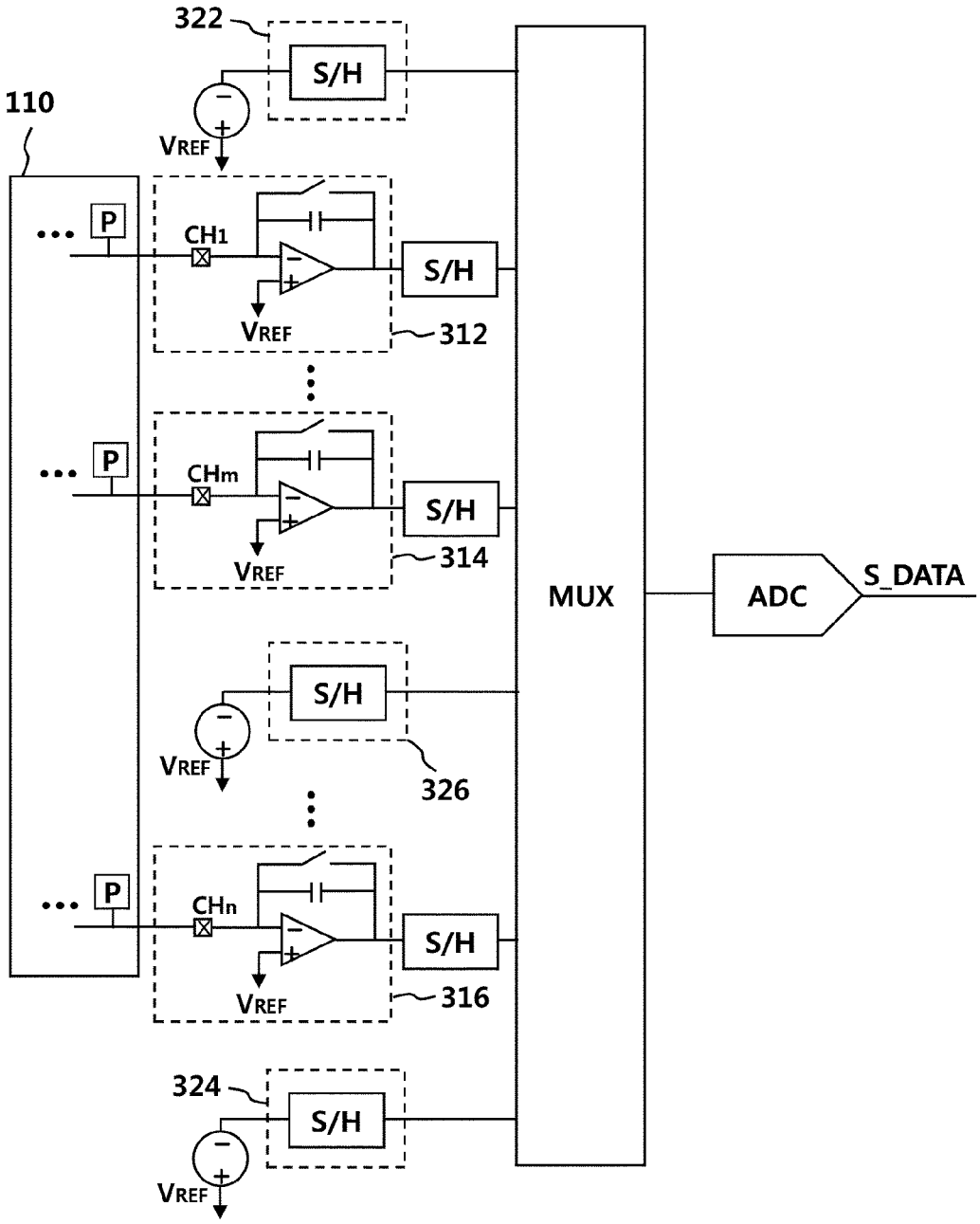

As illustrated in FIG. 4, the pixel sensing circuit 130 may further comprise a second reference sensing channel circuit 326 disposed adjacent to an M-th (M is a natural number greater than 2 and smaller than N) sensing channel circuit 314.

Figure 5A:
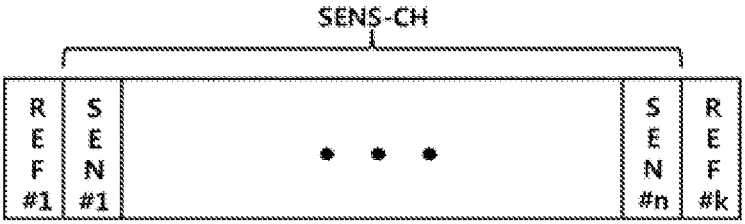
FIGS. 5A to 5D are diagrams for describing a configuration of an arrangement of a pixel sensing circuit according to an embodiment.

In other words, as illustrated in FIG. 5A, the pixel sensing circuit 130 may comprise reference sensing channel circuits REF #1 and REF #k disposed respectively at both ends of multiple sensing channel circuits SEN #1 to SEN #n. In this case, k may be 2 in FIG. 5A.

Figure 5B:
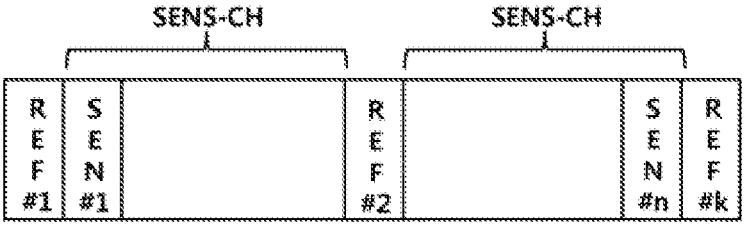

As illustrated in FIG. 5B, reference sensing channel circuits REF #1 and REF #k may be disposed respectively at both ends of multiple sensing channel circuits SEN #1 to SEN #n and a reference sensing channel circuit REF #2 may be further disposed in the middle of the multiple sensing channel circuits SEN #1 to SEN #n. In this case, k may be 3 in FIG. 5B.

Figure 5C:
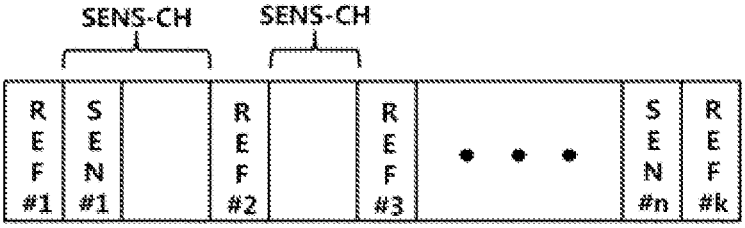

As illustrated in FIG. 5C, reference sensing channel circuits REF #1 and REF #k may be disposed respectively at both ends of multiple sensing channel circuits SEN #1 to SEN #n and one or more reference sensing channel circuits (e.g., REF #2 and REF #3) may be further disposed between every two adjacent sensing channel circuits SEN #1 to SEN #n. In this case, k may be a natural number greater than 3 and smaller than n in FIG. 5C.

Figure 5D:
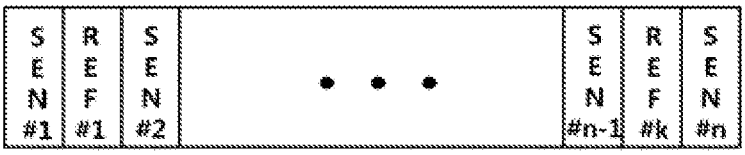

Otherwise, as illustrated in FIG. 5D, a first reference sensing channel circuit REF #1 may be disposed between a first sensing channel circuit SEN #1 and a second sensing channel circuit SEN #2 and a K-th reference sensing channel circuit REF #k may be disposed between an (N-1)-th sensing channel circuit SEN #n-1 and an N-th sensing channel circuit SEN #n. In this case, k may be 2 or 3 or a natural number greater than 3 and smaller than n in FIG. 5D.

As described above, when the pixel sensing circuit 130 is formed in the IC board, two reference sensing channel circuits are disposed respectively at both sides of the multiple sensing channel circuits SEN #1 to SEN #n or one or more reference sensing channel circuits are further disposed in the middle or in the intervals of the multiple sensing channel circuits SEN #1 to SEN #n. Accordingly, circuit characteristics, different depending on locations where the multiple sensing channel circuits SEN #1 to SEN #n are disposed, can be reflected in two or more reference sensing channel circuits.

In other words, all circuit characteristics of sensing channel circuits, which are different depending on locations where the multiple sensing channel circuits SEN #1 to SEN #n are disposed, can be reflected in two or more reference sensing channel circuits by disposing the two or more reference sensing channel circuits to be dispersed among the multiple sensing channel circuits SEN #1 to SEN #n.

Figure 6:
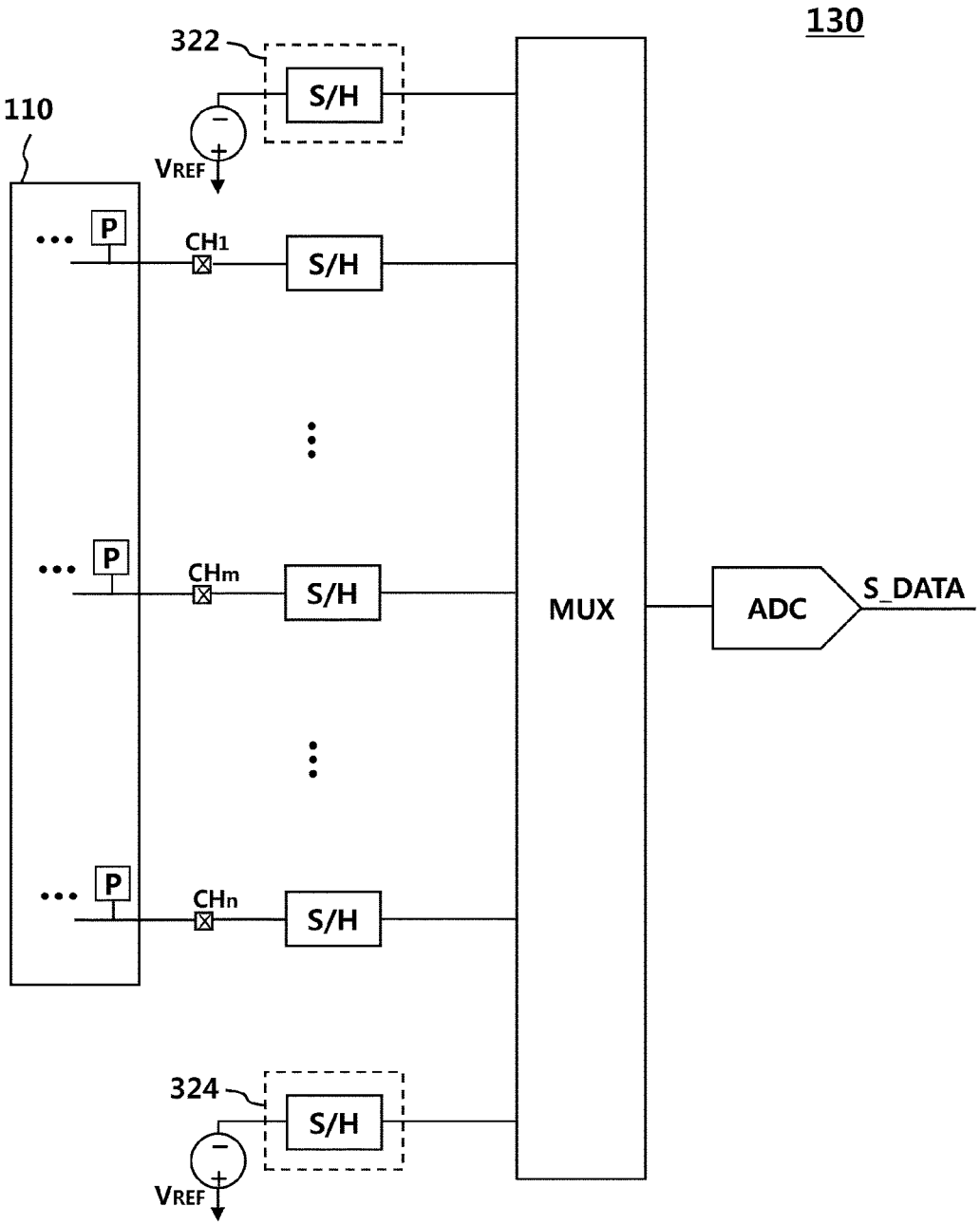
FIGS. 6 and 7 illustrate other configurations of a pixel sensing circuit according to an embodiment.
Figure 7:
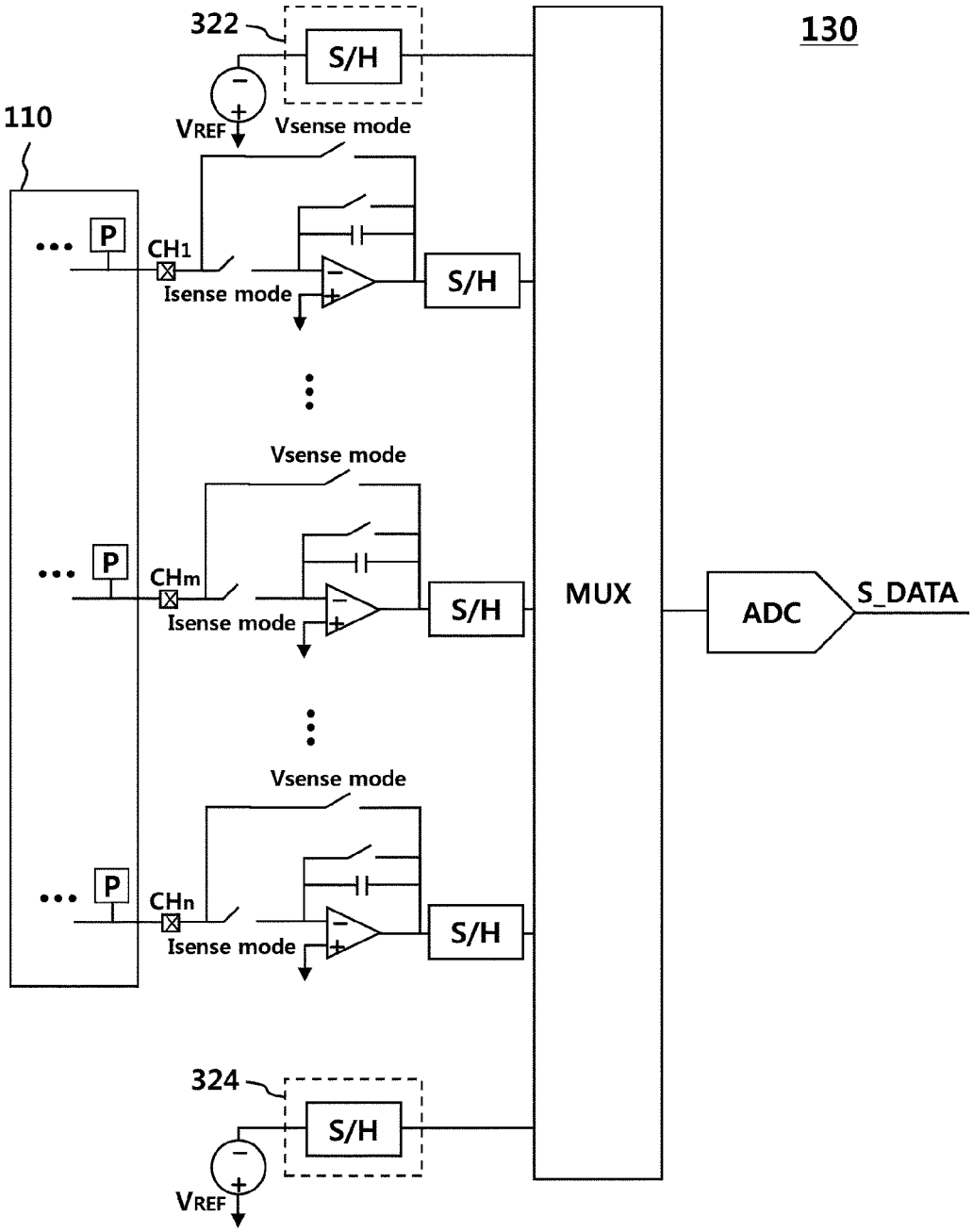

In an embodiment, the pixel sensing circuit 130 may further comprise a multiplexer (MUX) configured to receive a first pixel sensing value to an N-th pixel sensing value respectively outputted from the first sensing channel circuit 312 to the N-th sensing channel circuit 316, to receive a first reference sensing value and a K-th reference sensing value respectively outputted from the first reference sensing channel circuit 322 and the K-th reference sensing channel circuit 324, and to sequentially output the first pixel sensing value to the N-th pixel sensing value and the first reference sensing value to the K-th reference sensing value in an order of the circuit arrangement as shown in FIG. 6 and FIG. 7. Here, the circuit arrangement order may mean an order in which the first sensing channel circuit 312 to the N-th sensing channel circuit 316 and the first reference sensing channel circuit 322 to the K-th reference sensing channel circuit 324 are arranged in the IC board.

The pixel sensing circuit 130 may further comprise an analog-to-digital converter (ADC) configured to receive the first pixel sensing value to the N-th pixel sensing value and the first reference sensing value to the K-th reference sensing value from the MUX and to convert the first pixel sensing value to the N-th pixel sensing value and the first reference sensing value to the K-th reference sensing value respectively into first pixel sensing data to N-th pixel sensing data and first reference sensing data to K-th reference sensing data. Here, the first pixel sensing value to the N-th pixel sensing value and the first reference sensing value to the K-th reference sensing value may be analog signals. The first pixel sensing data to the N-th pixel sensing data and the first reference sensing data to the K-th reference sensing data may be digital signals.

The pixel sensing circuit 130 may further comprise a sample and hold circuit (S/H) disposed between the MUX and each of the first sensing channel circuit 312 to the N-th sensing channel circuit 316. Here, the sample and hold circuits S/H may receive the first pixel sensing value to the N-th pixel sensing value respectively outputted from the first sensing channel circuit 312 to the N-th sensing channel circuit 316, maintain the received pixel sensing values for a predetermined time, and output the pixel sensing values to the MUX.

In the above, the circuits that measure characteristics of pixels P using currents Isense received through the sensing lines SL have been chiefly described for the convenience of description. However, an embodiment may also be applied to circuits that measure characteristics of pixels P using voltages Vsense as illustrated in FIG. 6 or circuits that measure characteristics of pixels P by selectively using currents Isense or voltages Vsense as illustrated in FIG. 7.

Hereinafter, a panel driving device comprising the pixel sensing circuit 130 is described.

Figure 8:
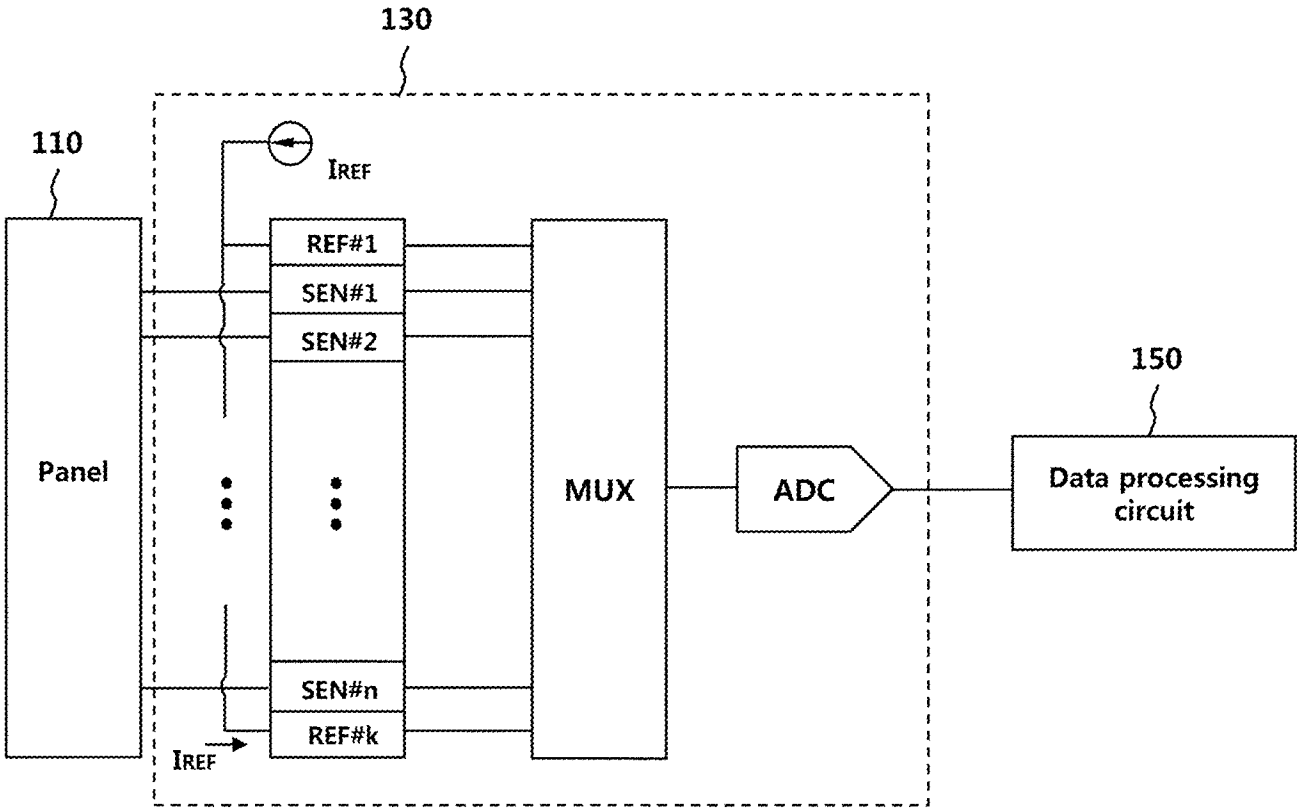
FIG. 8 illustrates a configuration of a panel driving device according to an embodiment.
Figure 9:
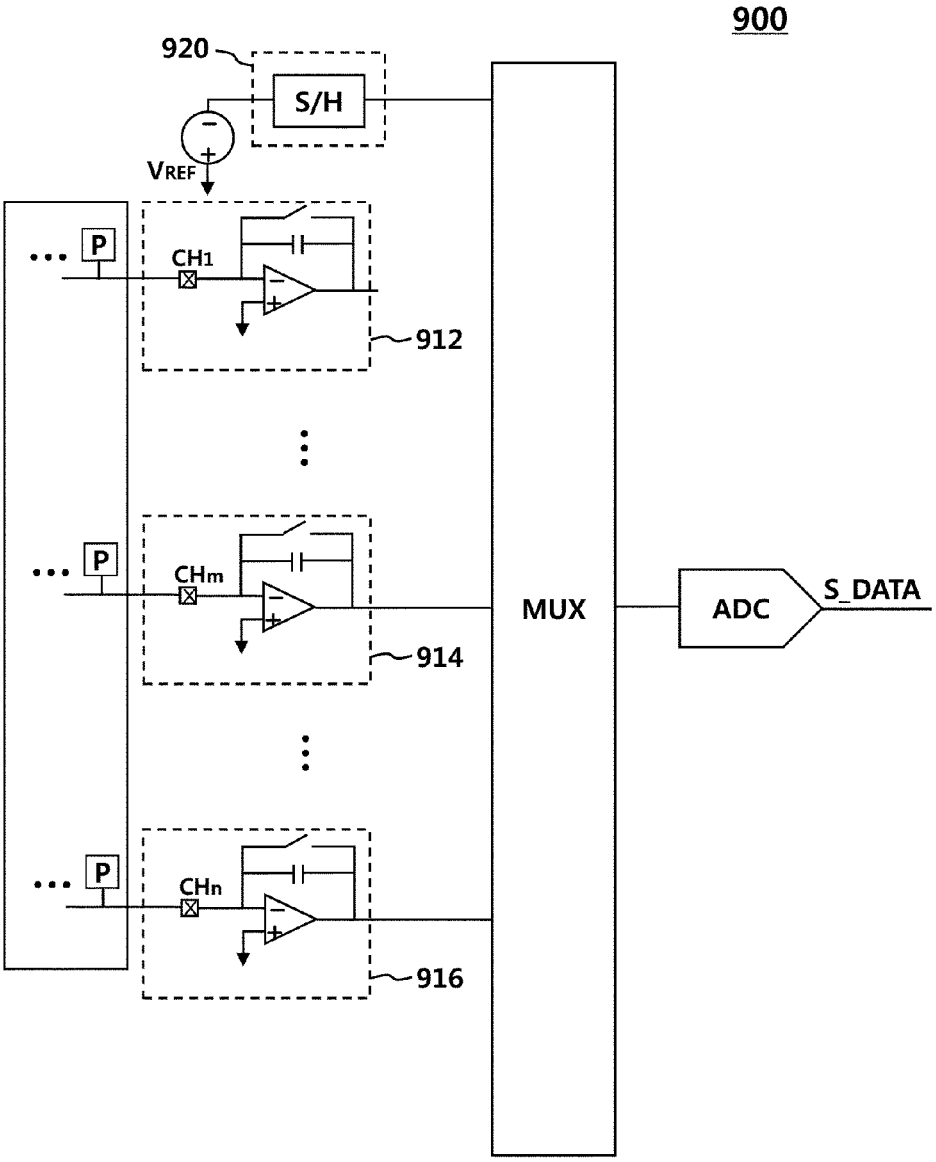
FIG. 9 (Prior Art)
FIG. 9 illustrates a configuration of a known pixel sensing circuit.

FIG. 8 illustrates a configuration of the panel driving device according to an embodiment.

Referring to FIG. 8, the panel driving device may comprise the display panel 110, the pixel sensing circuit 130, and the data processing circuit 150. The panel driving device may further comprise the data driving circuit 120.

The pixel sensing circuit 130 may generate a first pixel sensing value to an N-th pixel sensing value for characteristics of pixels disposed in the display panel 110. To this end, the pixel sensing circuit 130 may include multiple sensing channel circuits SEN #1 to SEN #n sequentially disposed in an IC board, that is, a first sensing channel circuit 312 SEN #1 to an N-th sensing channel circuit 316 SEN #n.

The pixel sensing circuit 130 may generate a first reference sensing value to a K-th reference sensing value for a preset reference voltage. To this end, the pixel sensing circuit 130 may include a first reference sensing channel circuit 322 REF #1 disposed adjacent to the first sensing channel circuit 312 SEN #1 in the IC board and a K-th reference sensing channel 324 REF #k disposed adjacent to the N-th sensing channel circuit 316 SEN #n in the IC board.

The pixel sensing circuit 130 may further include a second reference sensing channel circuit 326 REF #2 disposed adjacent to an M-th sensing channel circuit 314. In other words, the pixel sensing circuit 130 may further include one or more reference sensing channel circuits disposed in the middle or in the intervals of the multiple sensing channel circuits SEN #1 to SEN #n.

As described above, the pixel sensing circuit 130 may generate the first pixel sensing value to the N-th pixel sensing value and the first reference sensing value to the K-th reference sensing value, convert the first pixel sensing value to the N-th pixel sensing value respectively into first pixel sensing data to N-th pixel sensing data, convert the first reference sensing value to the K-th reference sensing value respectively into first reference sensing data to K-th reference sensing data, and transmit the first pixel sensing data to the N-th pixel sensing data and the first reference sensing data to the K-th reference sensing data to the data processing circuit 150. Here, the first pixel sensing value to the N-th pixel sensing value and the first reference sensing value to the K-th reference sensing value may be analog signals. The first pixel sensing data to the N-th pixel sensing data and the first reference sensing data to the K-th reference sensing data may be digital signals.

In an embodiment, the first reference sensing data may be sensing data reflecting characteristics of sensing channel circuits (including the first sensing channel circuit) disposed adjacent to the first reference sensing channel circuit 322 REF #1 and the K-th reference sensing data may be sensing data reflecting characteristics of sensing channel circuits (including the N-th sensing channel circuit) disposed adjacent to the K-th reference sensing channel circuit 324 REF #k.

The data processing circuit 150 may receive the first pixel sensing data to the N-th pixel sensing data and the first reference sensing data to the K-th reference sensing data from the pixel sensing circuit 130, and compensate for the first pixel sensing data to the N-th pixel sensing data using the first reference sensing data to the K-th reference sensing data.

Here, the data processing circuit 150 may calculate an average value of the first reference sensing data and the K-th reference sensing data.

The data processing circuit 150 may compensate for the first pixel sensing data to the N-th pixel sensing data using the average value.

In addition, the data processing circuit 150 may calculate an average value by multiplying the first reference sensing data to the K-th reference sensing data by a preset first weight to K-th weight and averaging their multiplication results. Here, a characteristic of a fabrication process of an IC 125 may be reflected in the first weight to the K-th weight.

The data processing circuit 150 may compensate for the first pixel sensing data to the N-th pixel sensing data using an average value calculated as described above.

The data processing circuit 150 may perform compensation processing on image data RGB using the first pixel sensing data to the N-th pixel sensing data compensated as described above.

The data driving circuit 120 may convert the image data RGB, subjected to compensation processing, into a data voltage in the data processing circuit 150 and supply the data voltage to a data line.

As described above, according to the present disclosure, when the pixel sensing circuit 130 is formed in an IC board, two reference sensing channel circuits may be disposed respectively on both end sides of the multiple sensing channel circuits or one or more reference sensing channel circuits may be further disposed in the middle or in the intervals of the multiple sensing channel circuits. Accordingly, two or more reference sensing channel circuits can output reference sensing values reflecting circuit characteristics different depending on locations where the multiple sensing channel circuits are disposed and this allows improving the sensing accuracy of the entire sensing channel circuits.

While particular embodiments and applications have been illustrated and described, it is to be understood that the invention is not limited to the precise construction and components disclosed herein and that various modifications, changes and variations which will be apparent to those skilled in the art may be made in the arrangement, operation and details of the method and apparatus disclosed herein without departing from the spirit and scope of the present disclosure.

What is claimed is:

1. A pixel sensing circuit configured to sense characteristics of multiple pixels disposed in a display panel, comprising:

a first sensing channel circuit to an N-th (N is a natural number of 2 or greater) sensing channel circuit sequentially disposed in an integrated circuit board;

a first reference sensing channel circuit configured to receive a preset reference voltage and to output a first reference sensing value for the reference voltage, and the first reference sensing channel circuit being disposed adjacent to the first sensing channel circuit in the integrated circuit board; and a K-th (K is a natural number greater than 1 and smaller than N) reference sensing channel circuit configured to receive the reference voltage and to output a K-th reference sensing value for the reference voltage, the K-th reference sensing channel circuit being disposed adjacent to the N-th sensing channel circuit in the integrated circuit board.

2. The pixel sensing circuit of claim 1, further comprising:

a second reference sensing channel circuit to receive the reference voltage and to output a second reference sensing value for the reference voltage, and the second reference sensing channel circuit being disposed adjacent to an M-th (M is a natural number greater than 2 and smaller than N) sensing channel circuit in the integrated circuit board.

3. The pixel sensing circuit of claim 1, further comprising:

a multiplexer configured to receive a first pixel sensing value to an N-th pixel sensing value outputted from the first sensing channel circuit to the N-th sensing channel circuit, to receive the first reference sensing value and the K-th reference sensing value respectively outputted from the first reference sensing channel circuit and the K-th reference sensing channel circuit, and to sequentially output the first pixel sensing value to the N-th pixel sensing value, the first reference sensing value and the K-th reference sensing value in an order of an arrangement of the first sensing channel circuit to the N-th sensing channel circuit, the first reference sensing channel circuit and the K-th reference sensing channel circuit in the integrated circuit board; and an analog-to-digital converter configured to receive the first pixel sensing value to the N-th pixel sensing value, the first reference sensing value and the K-th reference sensing value from the multiplexer, and to convert the first pixel sensing value to the N-th pixel sensing value, the first reference sensing value and the K-th reference sensing value respectively into first pixel sensing data to N-th pixel sensing data, first reference sensing data and K-th reference sensing data.

4. The pixel sensing circuit of claim 1, wherein the first reference sensing channel circuit is disposed between the first sensing channel circuit and a second sensing channel circuit, and the K-th reference sensing channel circuit is disposed between an (N-1)-th sensing channel circuit and the N-th sensing channel circuit.

5. A panel driving device comprising:

a pixel sensing circuit configured to generate a first pixel sensing value to an N-th (N is a natural number of 2 or greater) pixel sensing value for characteristics of multiple pixels disposed in a display panel, to convert the first pixel sensing value to the N-th pixel sensing value into first pixel sensing data to N-th pixel sensing data, to generate a first reference sensing value to a K-th (K is a natural number greater than 1 and smaller than N) reference sensing value for a preset reference voltage, and to convert the first reference sensing value to the K-th reference sensing value into first reference sensing data to K-th reference sensing data; and a data processing circuit configured to receive the first pixel sensing data to the N-th pixel sensing data and the first reference sensing data to the K-th reference sensing data from the pixel sensing circuit and to compensate for each of the first pixel sensing data to the N-th pixel sensing data by using all of the first reference sensing data to the K-th reference sensing data.

6. The panel driving device of claim 5, wherein the data processing circuit calculates an average value of the first reference sensing data to the K-th reference sensing data and compensates for the first pixel sensing data to the N-th pixel sensing data using the average value.

7. A panel driving device comprising:

a pixel sensing circuit configured to generate a first pixel sensing value to an N-th (N is a natural number of 2 or greater) pixel sensing value for characteristics of multiple pixels disposed in a display panel, to convert the first pixel sensing value to the N-th pixel sensing value into first pixel sensing data to N-th pixel sensing data, to generate a first reference sensing value to a K-th (K is a natural number greater than 1 and smaller than N) reference sensing value for a preset reference voltage, and to convert the first reference sensing value to the K-th reference sensing value into first reference sensing data to K-th reference sensing data; and a data processing circuit configured to receive the first pixel sensing data to the N-th pixel sensing data and the first reference sensing data to the K-th reference sensing data from the pixel sensing circuit and to compensate for the first pixel sensing data to the N-th pixel sensing data using the first reference sensing data to the K-th reference sensing data, wherein the data processing circuit calculates an average value by multiplying the first reference sensing data to the K-th reference sensing data respectively by a preset first weight to K-th weight and averaging their multiplication results and compensates for the first pixel sensing data to the N-th pixel sensing data using the average value.

8. The panel driving device of claim 7, wherein the pixel sensing circuit comprises:

a first sensing channel circuit to an N-th sensing channel circuit sequentially disposed in an integrated circuit board and configured to respectively output the first pixel sensing value to the N-th pixel sensing value;

a first reference sensing channel circuit configured to receive the reference voltage and to output the first reference sensing value, the first reference sensing channel circuit being disposed adjacent to the first sensing channel circuit in the integrated circuit board; and a K-th reference sensing channel circuit configured to receive the reference voltage and to output the K-th (K is a natural number greater than 1 and smaller than N) reference sensing value, the K-th reference sensing channel circuit being disposed adjacent to the N-th sensing channel circuit in the integrated circuit board.

9. The panel driving device of claim 8, wherein the pixel sensing circuit further comprises:

a multiplexer configured to receive the first pixel sensing value to the N-th pixel sensing value outputted from the first sensing channel circuit to the N-th sensing channel circuit, to receive the first reference sensing value to the K-th reference sensing value respectively outputted from the first reference sensing channel circuit to the K-th reference sensing channel circuit, and to sequentially output the first pixel sensing value to the N-th pixel sensing value and the first reference sensing value to the K-th reference sensing value in an order of an arrangement of the first sensing channel circuit to the N-th sensing channel circuit, the first reference sensing channel circuit and the K-th reference sensing channel circuit in the integrated circuit board; and an analog-to-digital converter configured to convert the first pixel sensing value to the N-th pixel sensing value and the first reference sensing value to the K-th reference sensing value into digital values and to transmit the digital values to the data processing circuit.

10. The panel driving device of claim 7, further comprising:

a data driving circuit configured to convert image data into a data voltage and to supply the data voltage to a data line, wherein the data processing circuit performs compensation processing on the image data using the first pixel sensing data to the N-th pixel sensing data.

* * * * *